US006556116B2

(12) United States Patent
Skinner et al.

(10) Patent No.: US 6,556,116 B2
(45) Date of Patent: Apr. 29, 2003

(54) EROSION RESISTANT PENCIL COIL HAVING EXTERNAL SECONDARY WINDING AND SHIELD

(75) Inventors: Albert Anthony Skinner, Anderson, IN (US); Kenneth P. Senseman, Noblesville, IN (US); James Alva Boyer, Anderson, IN (US); David D. Jackson, Anderson, IN (US); Viorel N. Moga, Anderson, IN (US); Mark Albert Paul, Fishers, IN (US)

(73) Assignee: Delphi Technologies, Inc., Troy, MI (US)

( * ) Notice: Subject to any disclaimer, the term of this patent is extended or adjusted under 35 U.S.C. 154(b) by 68 days.

(21) Appl. No.: 09/933,243

(22) Filed: Aug. 20, 2001

(65) Prior Publication Data

US 2003/0034866 A1 Feb. 20, 2003

(51) Int. Cl.[7] ..... H01F 27/02
(52) U.S. Cl. ..... 336/96; 336/92; 336/90
(58) Field of Search ..... 336/90, 92, 96; 123/634, 635

(56) References Cited

U.S. PATENT DOCUMENTS 6,463,674 B1 * 10/2002 Meyers et al. ..... 34/304
6,463,918 B1 * 10/2002 Moga et al. ..... 123/633

FOREIGN PATENT DOCUMENTS

JP 409246073 * 9/1997 ..... 336/92

* cited by examiner

*Primary Examiner*—Anh Mai
(74) *Attorney, Agent, or Firm*—Margaret A. Dobrowitsky

(57) ABSTRACT

A method for inhibiting or eliminating case erosion in a pencil ignition coil having an internal primary winding and an external secondary winding and shield. Three alternative means for resisting damage due to the partial discharge phenomenon arising from a high electric field in such coil configurations are provided: (i) applying an ozone resistant coating on the case; (ii) applying a coating on the case for eliminating partial discharge under the shield; and (iii) applying a polyimide tape covering to the case for resisting partial discharge under the shield. Several significant benefits include: an increased commercial value by allowing the use of an efficient internal primary winding which increases energy density and eliminates the need for a spool, thereby lowering the manufacturing costs, the processing costs falling well beneath that of liquid polymer processing, the ease of processing by coating or molding, the reduction of electrical noise, the improved durability even through thermal cycling, and the lowering of case manufacturing costs by allowing the use of lower cost plastic.

39 Claims, 6 Drawing Sheets

EROSION RESISTANT PENCIL COIL HAVING EXTERNAL SECONDARY WINDING AND SHIELD

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to the construction of pencil ignition coils used in the automotive industry, and more particularly to methods of preventing case erosion in pencil coils having a secondary wound external to the primary and the shields located external to the case.

2. Description of the Background Art

Automotive pencil ignition coils known in the art are generally used to transform voltage from the 12-volt battery to a substantially higher voltage needed for ignition. Such ignition coils typically have a core with primary and secondary windings. A pencil ignition coil that has a secondary winding external to its primary winding and a shield located external to a case will yield a higher energy capability than one where the primary is wound external to the secondary. The higher energy capability is obtained because the primary winding may be wound onto a core, which eliminates the need for a spool and allows for a larger core and greater energy density.

A known pencil ignition coil configuration is generally shown in FIG. 1 and FIG. 2. FIG. 1 is a schematic diagram showing the basic configuration of an ignition coil 10, having a primary winding 12 around core 14 which is internal to a secondary winding 16. These elements are housed in a case 18 covered by a shield 20, wherein an air gap 22 is located between the case 18 and the shield 20. The air gap 22 is not drawn to scale.

Unfortunately, a pencil ignition coil having a configuration as shown in FIG. 1 may suffer damage to the case 18 because of the high electrical field that occurs between the case and the shield. As shown in FIG. 2, partial discharge arises from ionization of air 24 in the gap 22 located between the case 18 and the shield 20, producing ozone ($O_3$) 26. This ionization of air 24 into ozone 26 is called the phenomenon of "partial discharge" and occurs whenever an air gap 22 wider than approximately five microns experiences the presence of a high electric field as is typically created by a pencil ignition coil 10 having an internal primary winding 12, an external secondary winding 16, and a shield 20 located external to the case 18. Partial discharge causes case-erosion, resulting in an eroded layer 28, which leads to eventual failure of the entire pencil ignition coil 10. Therefore, there is a need for a method of inhibiting case erosion in pencil ignition coils that has an internal primary winding. The present invention satisfies that need, as well as others, and overcomes the deficiencies found in conventional coils.

BRIEF SUMMARY OF THE INVENTION

The present invention comprises a protected erosion-resistant pencil ignition coil assembly and a method for fabricating the erosion-resistant pencil ignition coil assembly. The present invention also comprises several means for resisting damage due to the partial discharge phenomenon: (1) fabricating a pencil ignition coil having a coating for resisting erosion of the case by ozone; (2) fabricating a pencil ignition coil having a coating for eliminating partial discharge under a shield; and (3) fabricating a pencil coil having a polyimide tape covering for resisting partial discharge under a shield. A polyimide tube may also be used, assembled over the case and under the shield.

By way of example, and not of limitation, according to one aspect of the invention, the case is coated with a material that is resistant to the ozone that is produced when the air ionizes upon partial discharge. Suitable materials include, but are not limited to, titanium dioxide or silicon dioxide in a base such as paint, E-coat, polyester, or any other material that acts as a carrier and adheres to the case when dried or cured.

According to another aspect of the invention, the case is either electroplated or coated with a substrate material such as paint, polyester, epoxy or the like that is highly filled with a conductive material. Suitable conductive materials include, but are not limited to, carbon black, aluminum, or iron. This coating would be in electrical contact with the shield that is also grounded and in intimate contact with the case. With the coating and the shield at the same potential, no field would exist between them and, therefore, the air could not ionize to produce ozone. This would also reduce electrical noise since the partial discharges are eliminated.

According to a still further aspect of the invention, one or more layers of Kapton CR™ tape, or other corona resistant polyimide, are attached to the case between the case and the shield. For example, a one half millimeter to three millimeter thick base polyimide material with a one half millimeter to two millimeter thick glue coating would be suitable. The tape would be pressed onto the case so that the glue displaces the air between the tape and case. The air between the tape and the shield may still ionize, but the tape would resist damage to the case from the partial discharge that would result from the ionization.

An object of the invention is to inhibit ozone caused case erosion in pencil coils having an internal primary winding.

Another object of the invention is to inhibit case damage from partial discharge in pencil coils having an internal primary winding.

Another object of the invention is to eliminate partial discharge in pencil coils having an internal primary winding. Another object of the invention is to provide for increased commercial value by allowing the use of an efficient internal primary winding that increases energy density.

Another object of the invention to eliminate the need for a spool in pencil coils, thereby lowering the manufacturing costs.

Another object of the invention is to provide for ease of processing by coating or molding.

Another object of the invention is to reduce electrical noise.

Another object of the invention is to improve durability even through thermal cycling.

Another object of the invention is to lower case manufacturing costs by allowing the use of lower cost plastics.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings, which are for illustrative purposes only.

DETAILED DESCRIPTION OF THE INVENTION

Referring more specifically to the drawings, for illustrative purposes the present invention is embodied in the apparatus and methods generally shown in FIG. 3 through FIG. 6. It will be appreciated that the apparatus may vary as to configuration and as to details of the parts, and that the method may vary as to the specific steps and sequence, without departing from the basic concepts as disclosed herein.

Figure 1:
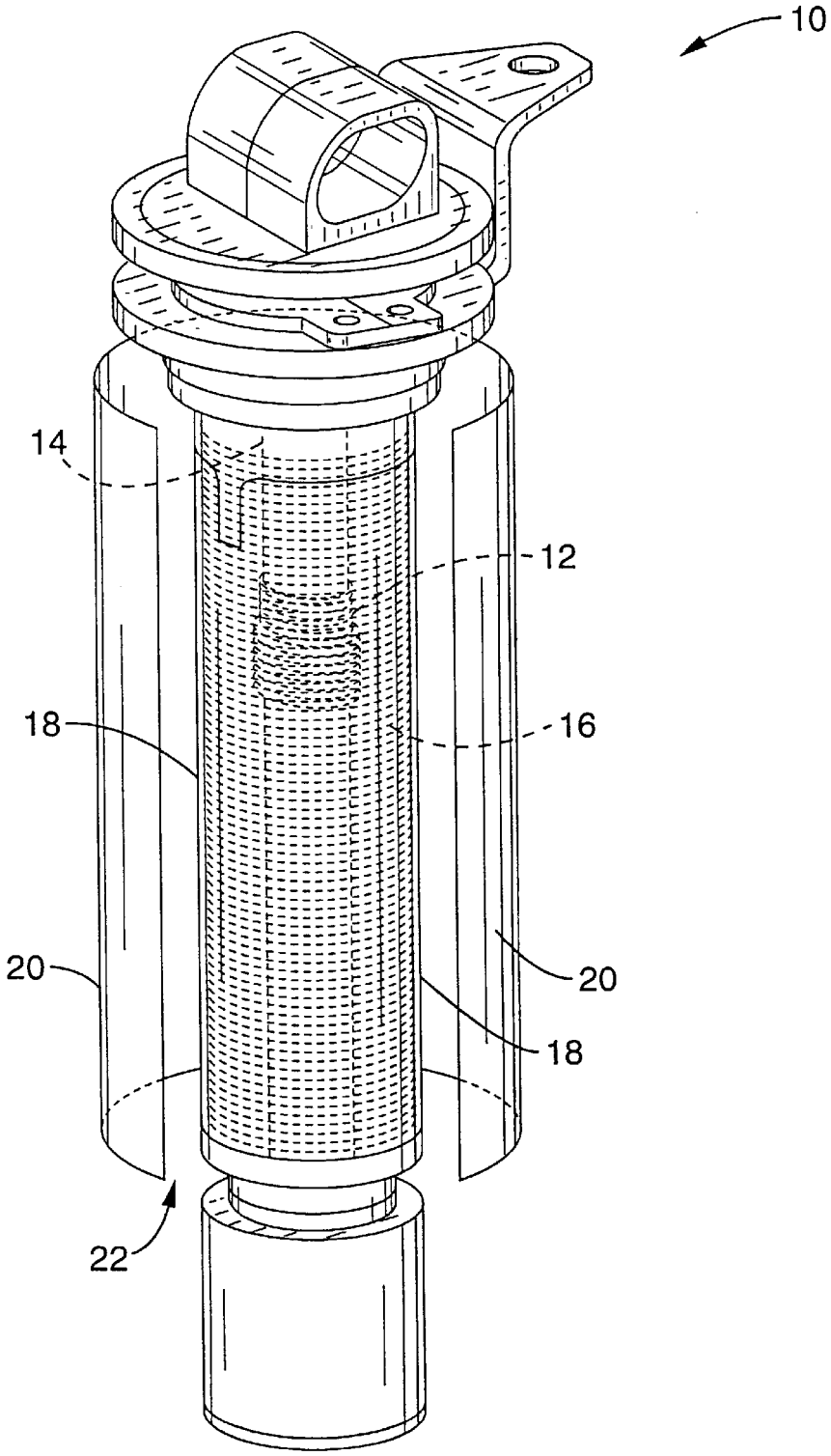
FIG. 1 (Prior Art)
FIG. 1 is a perspective schematic view of a conventional pencil ignition coil known in the art.
Figure 2:
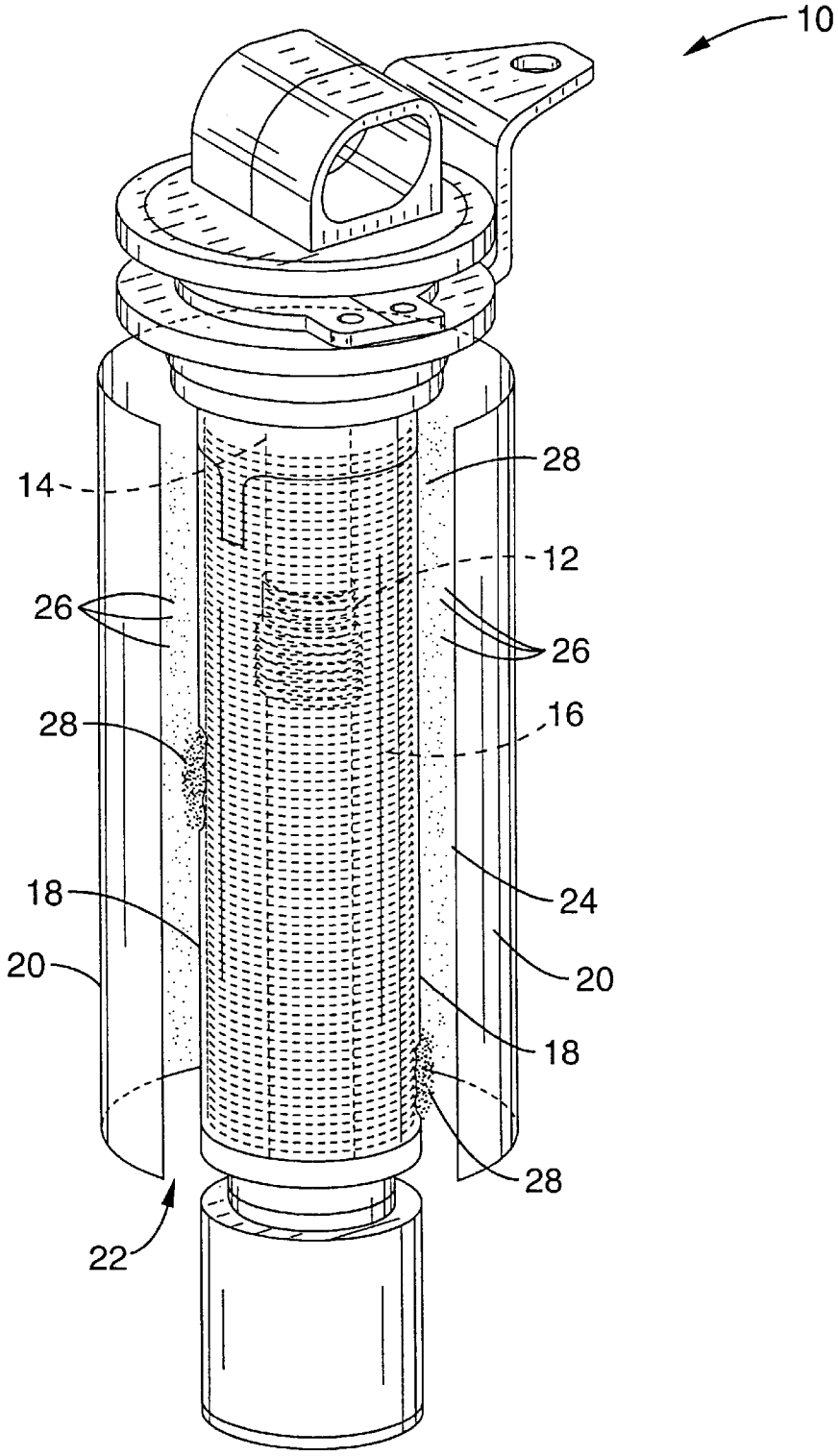
FIG. 2 (Prior Art)
FIG. 2 is a perspective schematic view of a conventional pencil ignition coil of FIG. 1 illustrating case corrosion.
Figure 3:
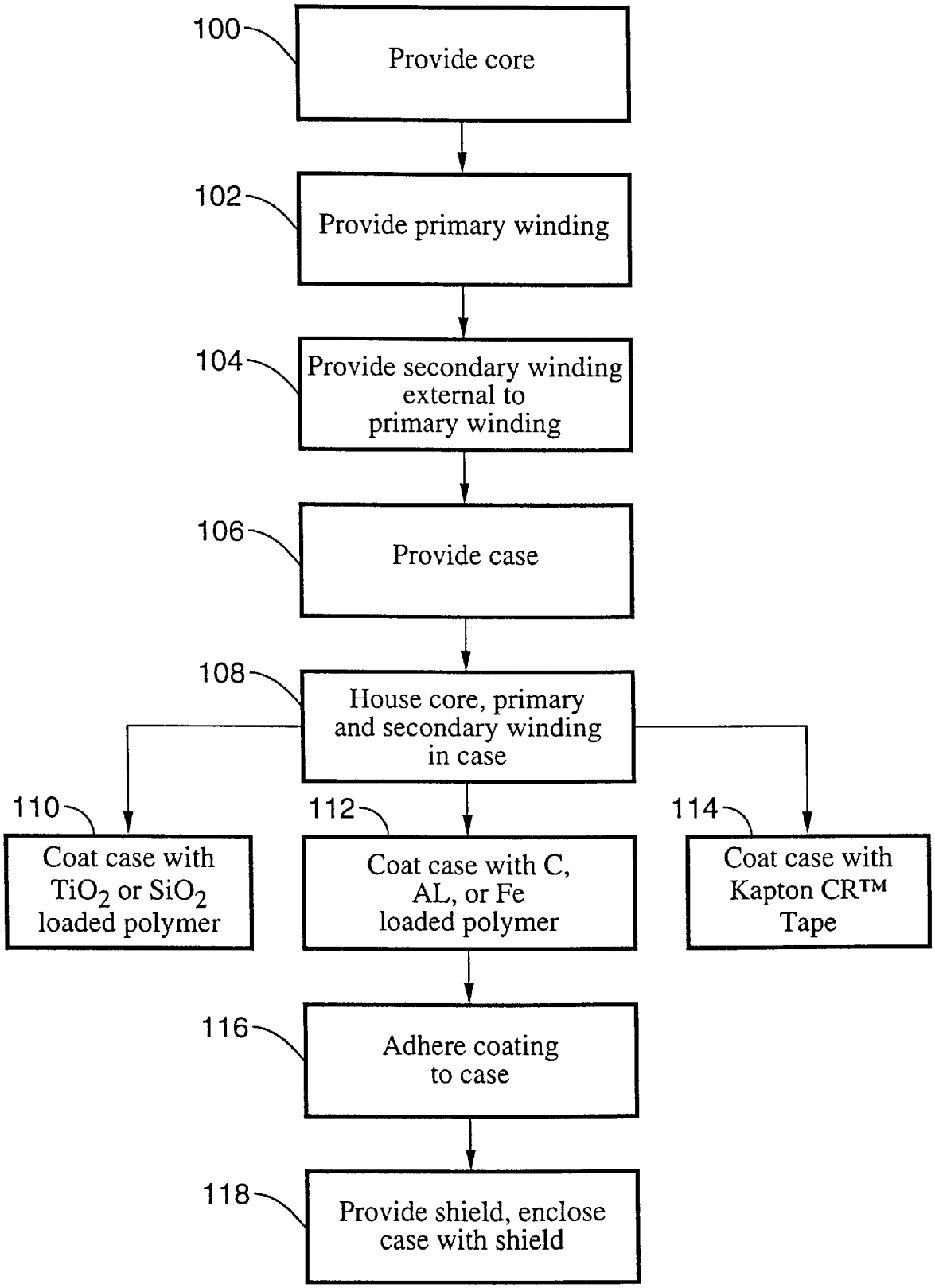
FIG. 3 is a flowchart demonstrating a method of fabricating a coated pencil ignition coil according to the present invention.

Referring now to FIG. 3, a method of fabricating a coated pencil ignition coil according to the present invention is shown. As can be seen, the method comprises the steps of providing a core as indicated by block 100; winding a primary around the core as indicated in block 102; providing a secondary winding, wherein said primary winding is internal to said secondary winding as indicated by block 104; providing a case as indicated by block 106; housing the core wound with the primary winding internal to the secondary winding in the case as indicated by block 108; coating the surface of the case with a protective material such as a $TiO_2$ or $SiO_2$ loaded polymer as indicted in block 110, a C, Al or Fe loaded polymer as indicated in block 112, or Kapton CR™ tape as indicated in block 114, thereby forming a coating film; causing said coating film to adhere to the surface of the case, thereby forming said protective coating on said surface of said case as indicated by block 116; and providing at least one shield for enclosing the case, wherein said shield is external to said case, wherein an air gap is located between said at least one shield and said case, and wherein said case has a surface facing said shield, as indicated by block 118. While the above description sets forth the steps for manufacturing a pencil ignition coil, it will be appreciated that the invention herein relates to the method and resultant structural configuration for inhibiting or eliminating case damage by using coatings described in block 110, 112, or 114.

Figure 4:
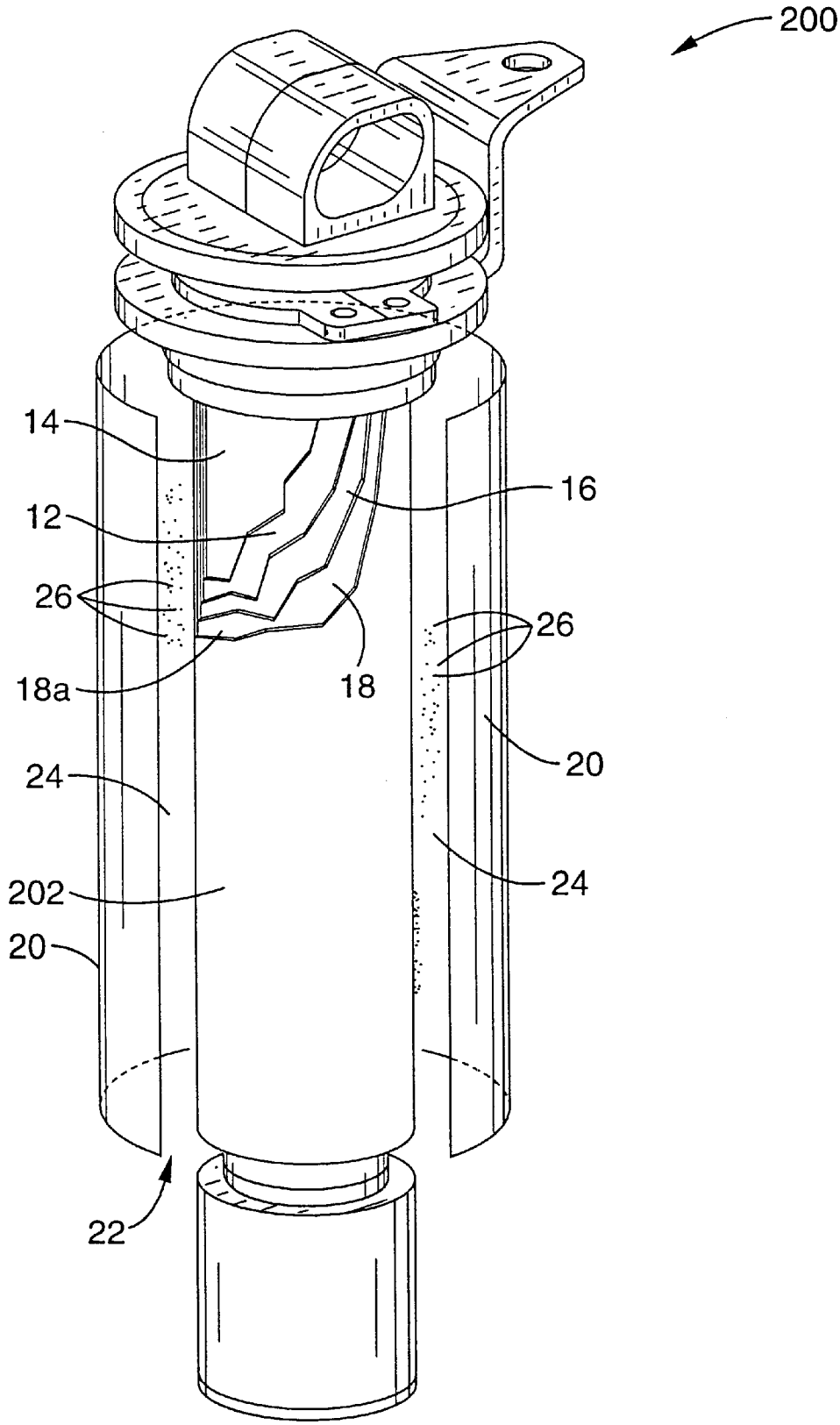
FIG. 4 is a perspective schematic view of a pencil ignition coil assembly according to FIG. 1 having a coating for resisting erosion or the case by ozone according to the present invention.

FIG. 4 illustrates a pencil ignition coil assembly 200 fabricated according to the above-described method. Coil 200 has an erosion-resistant coating 202 located on a surface 18*a* of a case 18 that is between the case 18 and shield 20 for resisting erosion of the case 18 by ozone ($O_3$) 26 generated by ionizing air 24 in air gap 22 as fabricated according to the method of the present invention wherein the coating step shown in block 110 is employed. The erosion-resistant coating 202 preferably comprises a base material 204 with good adhesive properties such as a paint, an epoxy, a polyester, a polyurethane, or any other suitable curable carrier material and an ozone-resistant inorganic additive 206 such as titanium dioxide, titania ($TiO_2$), or silicon dioxide, silica ($SiO_2$).

Figure 5:
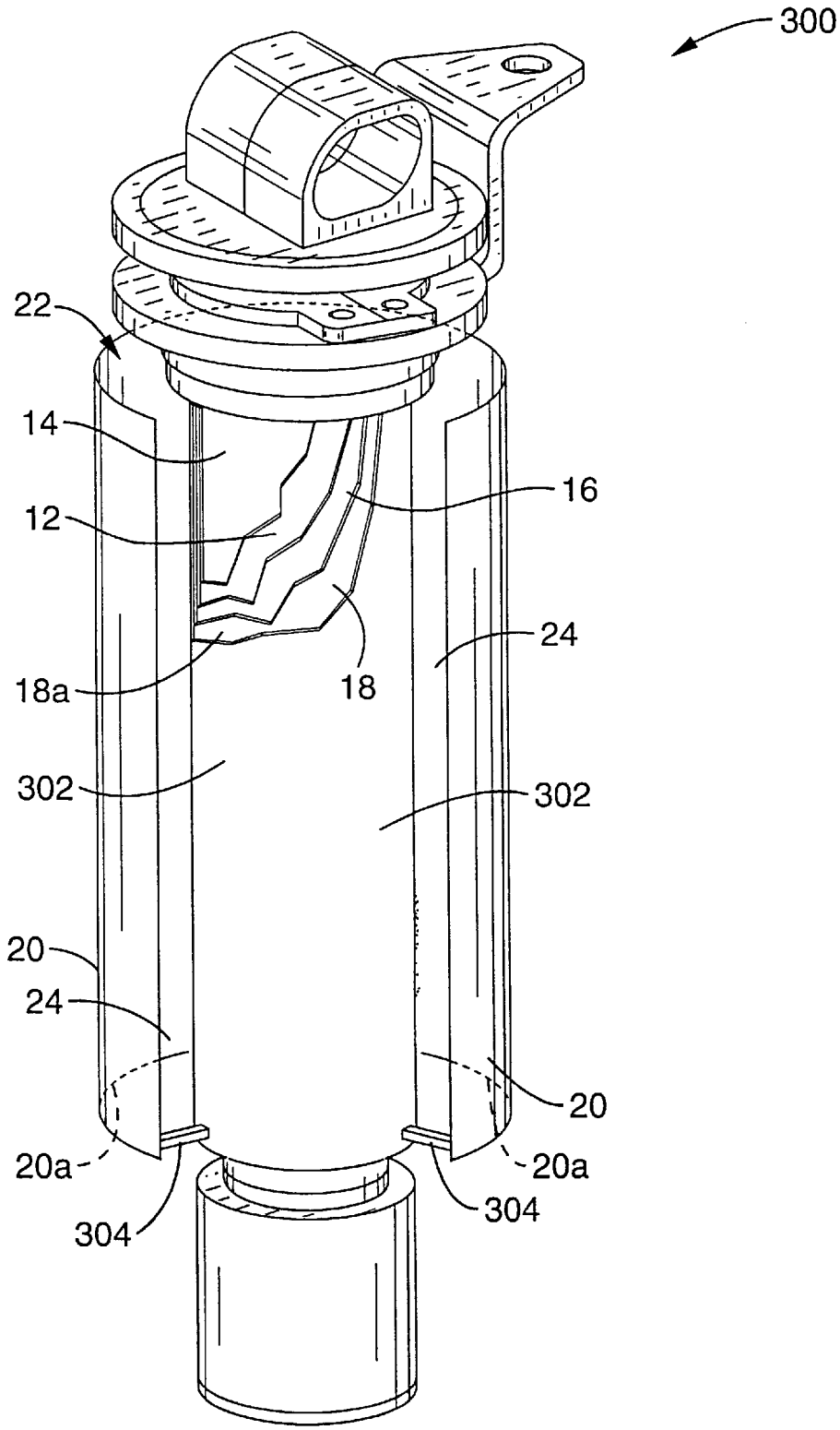
FIG. 5 is a perspective schematic view of a pencil ignition coil assembly according to FIG. 1 having a coating for eliminating partial discharge in accordance with the present invention.

FIG. 5 shows a pencil ignition coil assembly 300 fabricated according to the above-described method wherein the coating step shown in block 112 is employed. Coil 300 has a conductive coating 302 located on a surface 18*a* of a case 18 between the case 18 and shield 20. The conductive coating 302 is in electrical contact 304 with the shield 20, and, therefore, would have the same potential as the shield 20. The shield 20 is grounded and in intimate contact with the case 18. Thus, having the surface 18*a* coated with conductive coating 302 at the same potential as surface 20*a* of shield 20, no electric field would exist between the coating 302 and the shield 20. Therefore, the air 24 does not ionize in air gap 22 and partial discharge is eliminated. Electrical noise is also eliminated as partial discharges are eliminated. The conductive coating 302 preferably comprises a base material 306 with good adhesive properties such as a paint, an epoxy, a polyester, a polyurethane, or any other suitable curable carrier material having a conductive additive 308 such as carbon black (C), aluminum (Al), or iron (Fe). Alternatively, the case could be electroplated and the shield placed in intimate contact with the electroplated surface of the case or the electroplating could act as the shield.

Figure 6:
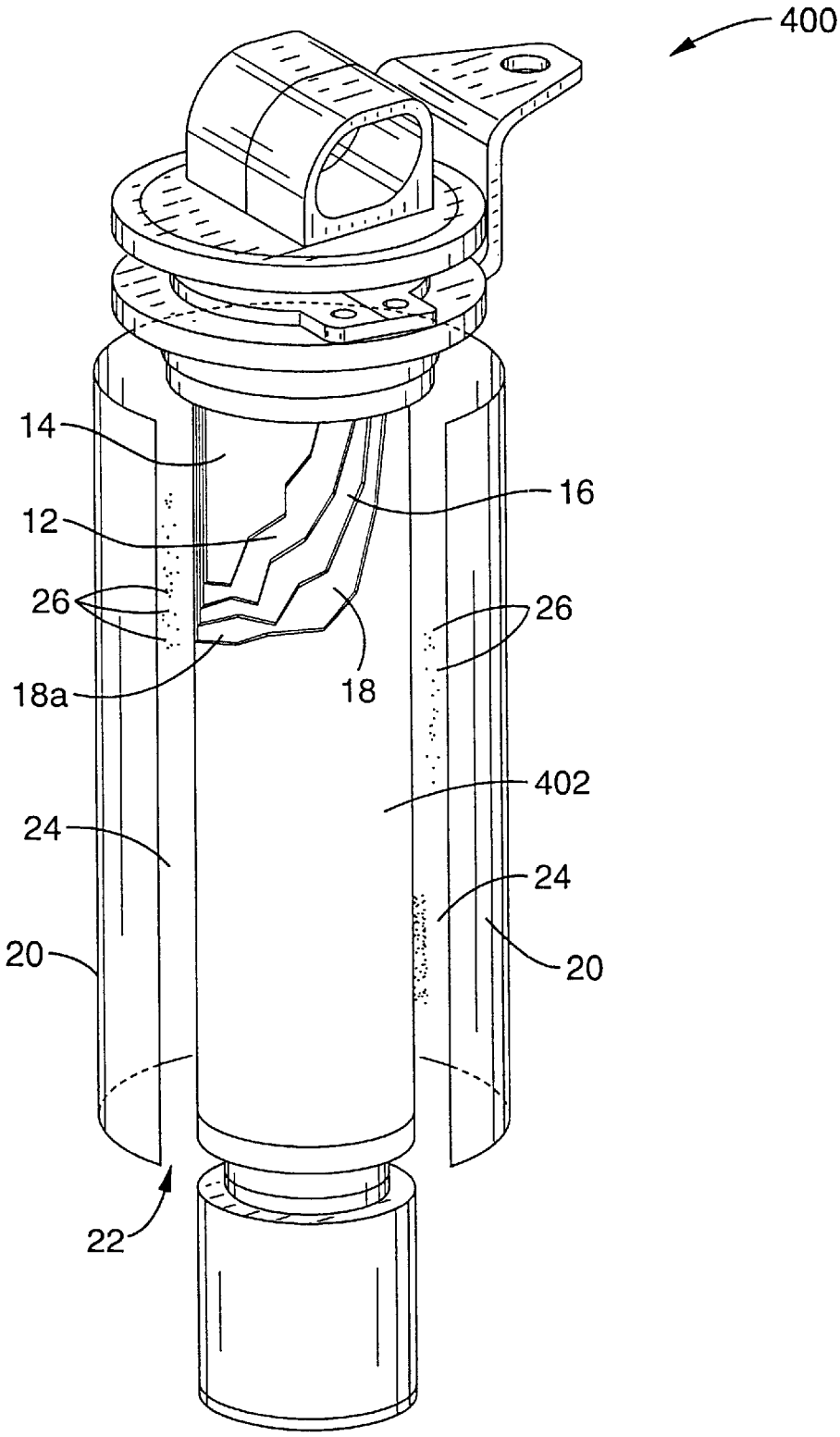
FIG. 6 is a perspective schematic view of a pencil ignition coil assembly according to FIG. 1 having a polyimide tape covering for resisting partial discharge in accordance with the present invention.

Referring now to FIG. 6, a pencil ignition coil assembly 400 fabricating according to the invention is shown, wherein the coating step shown in 114 is employed. Coil 400 has a corona-resistant polyimide covering 402 such as one or more windings of Kapton CR™ tape or the like located on the surface of the case 18 between case 18 and shield 20 for resisting partial discharge under shield 20. The corona-resistant polyimide covering 402 preferably comprises a polyimide film 404 in the range of approximately 0.5 mils to 3.0 mils in thickness and an adhesive layer 406 in the range of approximately 0.5 mils to 2.0 mils in thickness. In one embodiment, conductive material is also placed in the adhesive layer. The corona-resistant polyimide film 404 is pressed onto the surface 18*a* of the case 18 between the adhesive layer 406 and the shield 20 until all air bubbles are displaced. The air 24 outside of the corona-resistant polyimide covering 402 may still ionize, but the corona-resistant polyimide covering 402 resists damage due to partial discharge and the accumulation of ozone.

Although the description above contains many specificities, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated; but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A method for preventing case erosion in a pencil ignition coil of the type having an internal primary winding, an external secondary winding, a case surrounding the secondary winding, and a shield surrounding the case, comprising applying a protective coating to said case between said case and said shield.

2. A method as recited in claim 1, further comprising curing said protective coating after applying said protective coating to said case.

3. A method as recited in claim 1, wherein said protective coating comprises a polyimide film.

4. A method as recited in claim 3, wherein said polyimide film of said protective coating has a thickness in the range of approximately 0.5 mil to approximately 3.0 mils, and wherein said polyimide film has an adhesive backing having a thickness in the range of approximately 0.5 mil to approximately 2.0 mils.

5. A method as recited in claim 1, further comprising applying one or more additional protective coating layers to said case.

6. A method as recited in claim 5, wherein said additional protective coating layers comprises a polyimide film.

7. A method as recited in claim 5, wherein said polyimide film of each of said protective coating layers has a thickness in the range of approximately 0.5 mil to approximately 3.0 mils, and wherein said polyimide film has an adhesive backing having a thickness in the range of approximately 0.5 mil to approximately 2.0 mils.

8. A method as recited in claim 5, wherein each of said additional protective coating layers comprises a base material and an additive material.

9. A method as recited in claim 8, wherein said base material of each of said protective coating layers is selected from the group of polymeric materials consisting essentially of paint, epoxy, polyester, and polyurethane.

10. A method as recited in claim 8, wherein said additive material of each of said additional protective coating layers is selected from the group of inorganic compounds consisting essentially of titanium dioxide and silicon dioxide.

11. A method as recited in claim 8, wherein said additive material of said protective coating is a conductive material.

12. A method as recited in claim 11, further comprising the step of conductively bonding said coating to said shield.

13. A method as recited in claim 11, wherein said conductive material is selected from the group consisting essentially of carbon black, aluminum, and iron.

14. A method as recited in claim 1, wherein said protective coating comprises a base material and an additive material.

15. A method as recited in claim 14, wherein said base material of said protective coating is selected from the group of polymeric materials consisting essentially of paint, epoxy, polyester, and polyurethane.

16. A method as recited in claim 14, wherein said additive material of said protective coating is selected from the group of inorganic compounds consisting essentially of titanium dioxide and silicon dioxide.

17. A method as recited in claim 14, wherein said additive material of said protective coating is a conductive material.

18. A method as recited in claim 17, further comprising the step of conductively bonding said coating to said shield.

19. A method as recited in claim 17, wherein said conductive material is selected from the group consisting essentially of carbon black, aluminum, and iron.

20. A method for preventing case erosion in a pencil ignition coil of the type having an internal primary winding, an external secondary winding, a case surrounding the secondary winding, a shield surrounding the case, and an air gap between said shield and said case, comprising applying at least one protective coating to said case between said case and said shield, wherein said protective coating comprises a base material and an additive material.

21. A method as recited in claim 20, wherein said base material of said protective coating comprises a polyimide film and said additive material comprises an adhesive material.

22. A method as recited in claim 21, wherein said polyimide film base material has a thickness in the range of approximately 0.5 mil to approximately 3.0 mils, and wherein said polyimide film has an adhesive backing having a thickness in the range of approximately 0.5 mil to approximately 2.0 mils.

23. A method as recited in claim 20, wherein said base material of each of said protective coatings is selected from the group of polymeric materials consisting essentially of paint, epoxy, polyester, and polyurethane.

24. A method as recited in claim 20, wherein said additive material of each of said protective coatings is selected from the group of inorganic compounds consisting essentially of titanium dioxide and silicon dioxide.

25. A method as recited in claim 20, wherein said additive material of each of said protective coatings is selected from the group of conductive materials consisting essentially of carbon black, aluminum, and iron.

26. A pencil ignition coil of the type having an internal primary winding, an external secondary winding, a case surrounding the secondary winding, and a shield surrounding the case, wherein a protective coating is applied to said case between said case and said shield.

27. A pencil ignition coil as recited in claim 26, wherein said protective coating comprises a polyimide film.

28. A pencil ignition coil as recited in claim 27, wherein said polyimide film has a thickness in the range of approximately 0.5 mil to approximately 3.0 mils, and wherein said polyimide film has an adhesive backing having a thickness in the range of approximately 0.5 mil to approximately 2.0 mils.

29. A pencil ignition coil as recited in claim 26, wherein said protective coating comprises a base material and an additive material.

30. A pencil ignition coil as recited in claim 29, wherein said base material of said protective coating is selected from the group of polymeric materials consisting essentially of paint, epoxy, polyester, and polyurethane.

31. A pencil ignition coil as recited in claim 29, wherein said additive material of said protective coating is selected from the group of inorganic compounds consisting essentially of titanium dioxide and silicon dioxide.

32. A pencil ignition coil as recited in claim 29, wherein said additive material of said protective coating is selected from the group consisting essentially of carbon black, aluminum, and iron, and wherein said protective coating is conductively bonded to said shield.

33. A pencil ignition coil as recited in claim 26, wherein said protective coating further comprises one or more additional protective coating layers.

34. A pencil ignition coil as recited in claim 33, wherein said additional protective coating layers comprises a polyimide film.

35. A pencil ignition coil as recited in claim 34, wherein said polyimide film has a thickness in the range of approximately 0.5 mil to approximately 3.0 mils, and wherein said polyimide film has an adhesive backing having a thickness in the range of approximately 0.5 mil to approximately 2.0 mils.

36. A pencil ignition coil as recited in claim 33, wherein said additional protective coating layers comprise a base material and an additive material.

37. A pencil ignition coil as recited in claim 36, wherein said base material of each of said protective coating layers is selected from the group of polymeric materials consisting essentially of paint, epoxy, polyester, and polyurethane.

38. A pencil ignition coil as recited in claim 36, wherein said additive material of each of said protective coating layers is selected from the group of inorganic compounds consisting essentially of titanium dioxide and silicon dioxide.

39. A pencil ignition coil as recited in claim 36, wherein said additive material of each of said protective coating layers is selected from the group consisting essentially of carbon black, aluminum, and iron, and wherein said protective coating is conductively bonded to said shield.

* * * * *